United States Patent [19]

Goto et al.

[11] 4,094,277

[45] June 13, 1978

[54] INTAKE VALVE MECHANISM FOR PREVENTING BACK FLOW OF EXHAUST GAS

[75] Inventors: Kenji Goto; Daisaku Sawada, both of Susono, Japan

[73] Assignee: Tokyo Jidosha Kogyo Kabushiki Kaisha, Toyota, Japan

[21] Appl. No.: 694,445

[22] Filed: Jun. 9, 1976

[30] Foreign Application Priority Data

Jun. 24, 1975 Japan ..... 50-076441

[51] Int. Cl.[2] ..... F01L 1/28

[52] U.S. Cl. ..... 123/52 MF; 123/79 C; 123/188 VA

[58] Field of Search ..... 123/79 C, 52 MF, 188 AF, 123/188 S, 188 VA

[56] References Cited

U.S. PATENT DOCUMENTS

| | | | |
|---|---|---|---|
| 2,863,429 | 12/1958 | Bouteleux | 123/79 C |
| 3,903,855 | 9/1975 | Klakulak et al. | 123/79 C |
| 3,995,609 | 12/1976 | Klomp | 123/188 S |

*Primary Examiner*—Charles J. Myhre
*Assistant Examiner*—Craig R. Feinberg
*Attorney, Agent, or Firm*—Finnegan, Henderson, Farabow & Garrett

[57] ABSTRACT

The intake valve mechanism employs a back-flow valve to prevent undesirable back-flow of gases from a combustion chamber of an internal combustion engine out an intake port of the chamber during a period of time in which a poppet valve for the intake port of the chamber is open. The back-flow valve is positioned between an intake port valve seat and the intake port poppet valve for blocking the intake port in response to pressure in the combustion chamber. To minimize air-fuel resistance through the intake port, a spring is employed for continuously biasing the back-flow valve to track the movement of the poppet valve, the spring having sufficient strength to prevent the back-flow valve from blocking the intake port when the poppet valve is open until the pressure in the combustion chamber reaches a predetermined value.

6 Claims, 13 Drawing Figures

INTAKE VALVE MECHANISM FOR PREVENTING BACK FLOW OF EXHAUST GAS

BACKGROUND OF THE INVENTION

This invention is directed to an improved intake valve mechanism for an internal combustion engine and particularly to a back-flow valve designed to prevent gases in a combustion chamber from being blown back into an air-fuel intake port of the chamber and yet not impede the normal flow of air-fuel mixture passing into the chamber through the intake port.

In some four cycle internal combustion engines, intake and exhaust valves to the combustion chamber are both kept open simultaneously for a certain period in order to increase exhaust efficiency of the engine. However, as a consequence of both valves being open simultaneously, part of the exhaust gases burnt in the combustion chamber are blown past the open intake valve and back into the intake passage of the engine where the exhaust gases are mingled with the air-fuel mixture flowing through the intake passage during the next engine cycle. The exhaust gases impair ignition of the air-fuel mixture and therefore act to make the entire combustion operation of the engine unstable. The instability and accompanying inefficiency are particularly acute in the medium to low speed operational ranges of the engine and during idling of the engine.

In addition, modern internal combustion engines which are adapted to burn lean air-fuel mixtures in order to decrease the amount of toxic substances usually present in the engine exhaust gas, demand strict control of the air-fuel ratio. In this type of engine, the mingling of exhaust gas with the air-fuel mixture in the intake passage of the engine creates an even more acute operational deficiency.

The undesirable back-flow of gases from the combustion chamber to the intake passage is not limited to only the overlap period when both intake and exhaust valves are open. Back-flow can also occur when the intake valve is phased to close slightly behind the time at which the piston reaches bottom dead center of its cycle in order to raise the intake efficiency of the engine in its high speed operational range. In the medium to low speed range, fresh air-fuel mixture which enters the combustion chamber before the piston reaches the bottom dead center is forced back through the intake passage during the time when the piston passes bottom dead center and the intake valve remains open. The result is that in the medium to low speed range the intake efficiency of the engine is lowered instead of being improved.

The problem of gas back-flow is not limited to four cycle internal combustion engines. Even in a two cycle internal combustion engine, exhaust gases may blow back into the combustion chamber through the scavenging port due to pressure differentials set up by the operational cycle of the intake port.

In order to improve the output performance of such internal combustion engines, it is desirable to provide some means to prevent gas back-flow. The prior art has, to date, dealt with the problem of gas-back flow by employing an auxiliary intake or back-flow prevention valve slidably carried on a conventional intake poppet valve. For example, U.S. Pat. No. 3,903,855 discloses a back-flow intake valve normally spring-biased into closed position upstream of the intake poppet valve. The back-flow prevention valve is opened by pressure in the intake passage exceeding the pressure in the combustion chamber during the time interval when the intake poppet valve is open. By biasing the back-flow prevention valve in a normally closed position, the mass of the back-flow prevention valve functions as additional resistance against the intake flow of air-fuel mixture from the intake passage during the intake stroke and therefore lowers the intake efficiency of the engine. In the German Pat. No. 460,151 a back-flow prevention valve is disclosed with no biasing mechanism whatsoever and thus the intake flow of air-fuel mixture from the intake passage to the combustion chamber is once again faced with resistance from the mass of the back-flow prevention valve.

The present invention improves upon the intake valves of the prior art designed to prevent back-flow of gases in internal combustion engines. The present invention effectively combines a back-flow prevention valve with a biasing arrangement to result in a commercially-acceptable intake valve which not only effectively prevents back flow of gases into the intake passage of an internal combustion engine but also minimizes resistance against the intake flow of air-fuel mixture during the intake stroke of the engine and therefore maximizes the intake efficiency of the engine.

Accordingly, it is a prime object of this invention to provide a new and improved intake valve mechanism for preventing the back-flow of gases from the combustion chamber out the intake port.

It is a further object of this invention to provide an intake valve mechanism for preventing back-flow of gases that is simple in construction and easy to manufacture.

Another object of this invention is to provide an intake valve mechanism for preventing back-flow of gases that is designed to maximize the intake efficiency of the engine.

Still another object of this invention is to provide an intake valve mechanism for preventing back flow of gases that is designed to minimize the volume of back flow.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purpose of the invention, as embodied and broadly described herein, the intake valve mechanism for preventing the back-flow of gases from a combustion chamber of an internal combustion engine out an intake port of the chamber comprises poppet-valve means for alternately opening and blocking the intake port; back-flow valve means positioned between the poppet-valve means and the intake port for blocking the intake port in response to pressure in the combustion chamber; and means for continuously biasing the back-flow valve means to track the movement of the poppet valve, the biasing means having sufficient strength to prevent the back-flow valve means from blocking the intake port when the poppet valve is open until the pressure in the combustion chamber reaches a predetermined value.

Preferably, the poppet valve means includes an intake valve having a stem and further having a disc portion mounted on one end of the stem, the poppet valve means further including a valve guide for reciprocatingly supporting the stem to allow the disc portion to selectively open and block the intake port of the combustion chamber; the back-flow valve means includes a back-flow prevention valve having a hollow base and further having an expanded portion mounted on one end of the base, the hollow base being reciprocatingly mounted concentric to the stem to allow the expanded portion to slide back and forth between the intake port and the disc portion; and the biasing means includes a spring positioned concentric to the hollow base of the back-flow prevention valve to bias the expanded portion against the disc portion until the gases in the combustion chamber reach the predetermined pressure sufficient to overcome the spring and force the expanded portion away from the disc portion to block the intake port.

It is also preferred that the expanded portion of the back-flow prevention valve extends beyond the disc portion of the intake valve.

It is also preferred, in an alternative embodiment, that the disc portion of the intake valve extends beyond the expanded portion of the back-flow valve.

It is also preferred that the disc portion of the intake valve includes notches along the periphery of the disc portion and in the alternative, the disc portion of the intake valve includes openings penetrating through the disc portion, in either case to allow the gases in the combustion chamber to continuously exert pressure on the extended portion of the back-flow prevention valve.

the accompanying drawings, which are incorporated in and constitute a part of this specification, illustrate embodiments of the invention and, together with the description, serve to explain the principles of the invention.

DESCRIPTION OF THE DRAWINGS

FIGS. 1(*a*), (*b*) and (*c*) are diagrams illustrating the operation of the back-flow prevention valve of FIG. 1;

DESCRIPTION OF THE PREFERRED EMBODIMENT

Reference will now be made in detail to the present preferred embodiment of the invention, an example of which is illustrated in the accompanying drawings.

Figure 1:
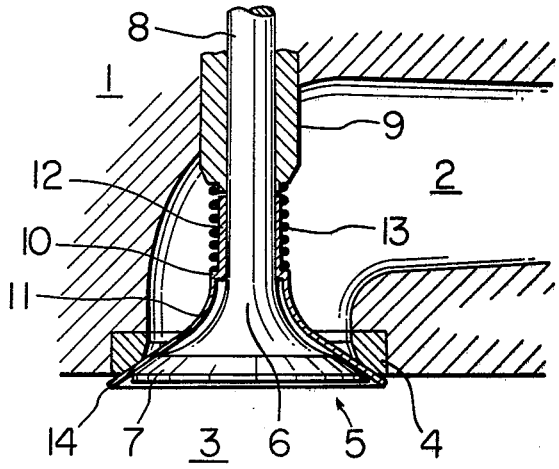
FIG. 1 is a cross-sectional view of an embodiment of an intake valve having back-flow prevention means constructed in accordance with the teachings of this invention.

Referring now to FIG. 1, a cylinder head 1 is provided with an intake passage 2 to carry a flow of air-fuel mixture into combustion chamber 3 of an internal combustion engine. A valve seat 4 is fitted at intake port 5 of intake passage 2 to form an opening into combustion chamber 3 through which the air-fuel mixture passes.

In accordance with the invention, there is a poppet valve means for alternately opening and blocking intake port 5. As embodied herein, the poppet-valve means includes an intake valve 6 having a stem 8 and further having a disc portion 7 mounted on one end of stem 8. The poppet-valve means further includes a valve guide 9, for reciprocatingly supporting stem 8 to allow disc portion 7 to selectively open and block intake port 5 of the internal combustion engine.

In accordance with the invention, there is a back-flow valve means positioned between the poppet-valve means and the intake port for blocking the intake port in response to pressure in the combustion chamber. As embodied herein, this back-flow valve means includes a back-flow prevention valve 10 having a hollow base 12 and further having an expanded portion 11 mounted on one end of base 12. The hollow base 12 is reciprocally mounted concentric to stem 8 to allow the expanded portion 11 to slide back and forth between intake port 5 and disc portion 7.

In accordance with the invention, there is means for continuously biasing the back-flow valve means to track the movement of the poppet valve means, this biasing means having sufficient strength to prevent the back-flow valve means from blocking the intake port when the poppet valve means is open until pressure in the combustion chamber reaches a predetermined value. As embodied herein, this biasing means includes a spring 13 positioned concentric to hollow base 12 of back-flow prevention valve 10 to bias the expanded portion 11 against the disc portion 7 until the pressure in the combustion chamber 3 is sufficient to overcome the combined strength of spring 13 and the pressure in intake passage 2. Upon reaching this predetermined pressure, the gases in combustion chamber 3 force the expanded portion 11 away from disc portion 7 and against valve seat 4 to block intake port 5.

Expanded portion 11 extends to an edge 14 that in the preferred embodiment shown in FIG. 1 projects beyond the edge of disc portion 7 to receive the pressure gases back-flowing from combustion chamber 3 into intake passage 2 at an initial stage of such back-flow. The expanded portion 11 is interposed between the disc portion 7 and the intake port 5 so that intake port 5 is closed when intake valve 6 is operated to pull expanded portion 11 and disc portion 7 against valve seat 4.

Preferably, spring 13 is positioned between valve guide 9 at one end and back flow prevention valve 10 at the other end to press the expanded portion 11 against disc portion 7 of intake valve 6.

Figure 2A:
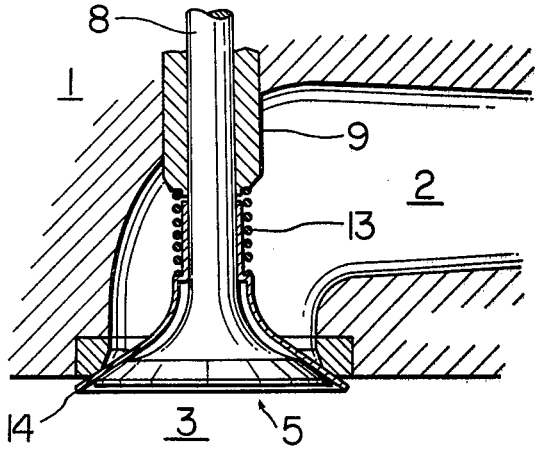
Figure 2B:
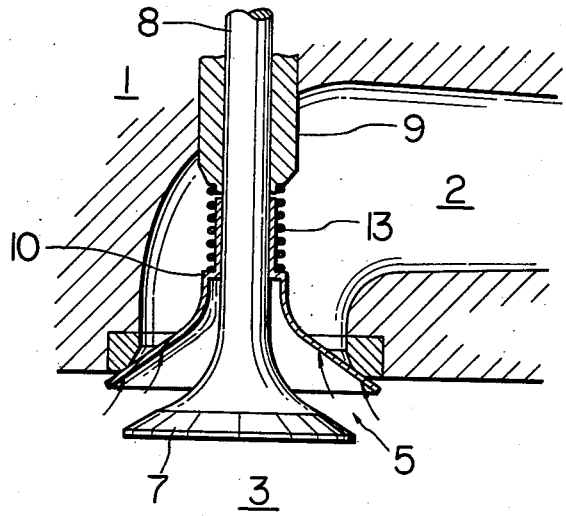
Figure 2C:
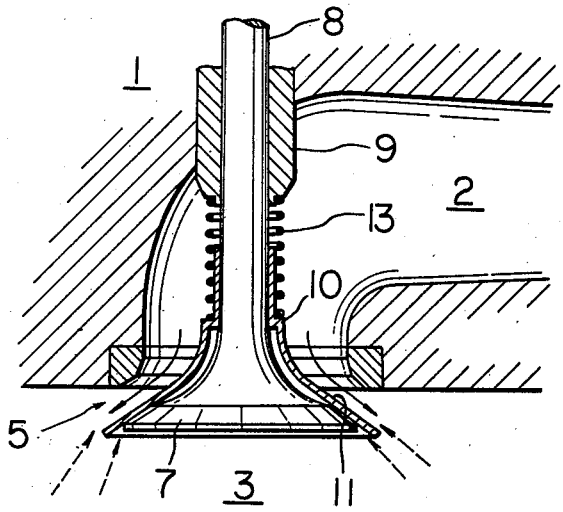

In operation of the present invention, reference is made to FIG. 2 (*a*) which illustrates the position of intake valve 6 while the engine is on an exhaust stroke. During this time, the combustion chamber 3 is filled with burnt exhaust gas, and an exhaust gas valve, not shown, is opened to enable the exhaust gases to escape from combustion chamber 3. In the ordinary engine, the intake valve 6 starts to open when the exhaust valve has not been perfectly closed creating a phenomenon known as the overlap period wherein both intake and exhaust valves are simultaneously opened. During this overlap period, if the pressure of the exhaust gas in combustion chamber 3 is higher than the pressure of the air-fuel mixture in intake passage 2, back-flow of exhaust gas would occur out intake port 5. However, in accordance with the present invention, as intake valve 6 is lowered as shown in FIG. 2 (*b*) by valve actuating means not shown, the pressure of the exhaust gas in combustion chamber 3 is received at edge 14 of expanded portion 11 of intake valve 6 to hold prevention valve 10 in its seated position against valve seat 4 and close off intake port 5. In this state, spring 13 is compressed and exerts a force which attempts to push the back-flow prevention valve 10 away from valve seat 4 to open intake port 5. Accordingly, when the pressure in combustion chamber 3 decreases below the sum of the pressure of spring 13 and the pressure of the air-fuel mixture in intake passage 2, the back flow prevention valve 10 is forced by spring 13 to depart from seat 4 of intake valve 5, and expanded portion 11 becomes pressed against disc portion 7 to open intake port 5 as illustrated in FIG. 2 (*c*).

As the pressure of the exhaust gases in combustion chamber 3 becomes greater than the combined pressure of spring 13 and the pressure of the air-fuel mixture in intake passage 2 while both intake valves 6 and back flow prevention valve 10 are open, the operation of the intake valve mechanism proceeds from the condition of FIG. 2 (*c*) back to that of FIG. 2 (*b*) and intake port 5 is once again blocked by back-flow prevention valve 10.

As will be understood in the above description, the intake valve mechanism of the present invention offers a back-flow prevention valve that is simple in construction and exact in operation. Also, since the back-flow prevention valve is used to close the intake port, the volume of exhaust gas back flow into the intake port 5 is much decreased as compared with a conventional engine in which there is no back-flow prevention valve or only a lead valve is fitted into the intake passage. Only a very slight amount of gas that is blown back as a result of the delay in response of the back-flow prevention valve 10 enters into the intake passage 2. Consequently, distrubance of the air-fuel ratio that might otherwise be caused by the back-flow exhaust gas is significantly minimized. In addition, the fact that the back-flow prevention valve 10 is continuously urged by spring 13 away from intake port 5 removes the resistance the mass of back flow prevention valve 10 creates against the intake flow of the air-fuel mixture. Accordingly, the intake valve mechanism of the present invention holds the lowering of intake efficiency to an absolute minimum.

The teachings of the present invention are in no means limited to the particular embodiment shown in FIG. 1, but instead can be practiced in various other forms of preferred embodiments as described below.

Figure 3:
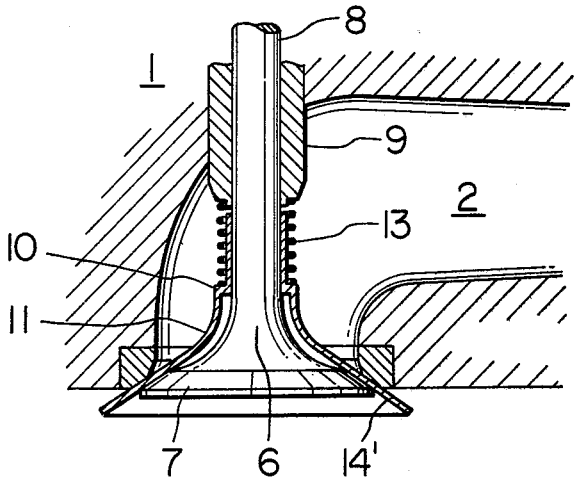
FIG. 3 is a cross-sectional view of another embodiment of this invention.

Thus, FIG. 3 discloses an intake valve mechanism constructed in accordance with the teachings of the invention in which the expanded portion 11 of the back-flow prevention valve 10 extends beyond the disc portion 7 of intake valve 6. In particular, edge 14' of the expanded portion 11 of the back-flow prevention valve is projected a considerable distance beyond the edge of disc portion 7 of the intake valve 6. As a consequence, the pressure of the gases in combustion chamber 3 may be received by such over extended edge 14' with greater ease.

Figure 4:
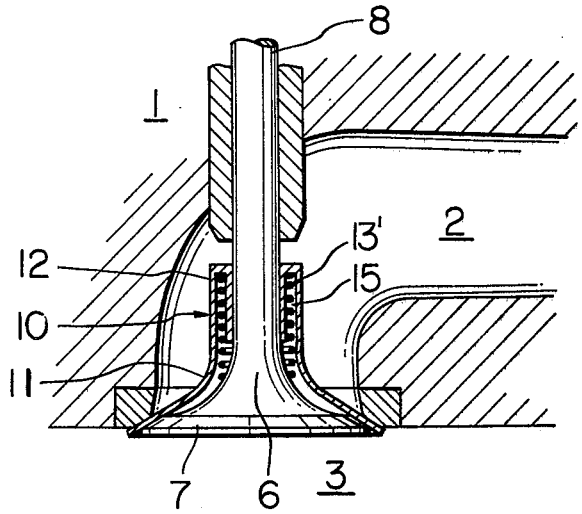
FIG. 4 is a cross-sectional view of still another embodiment of this invention.

In accordance with the invention, an embodiment of the intake valve mechanism disclosed in FIG. 4 includes an annular space 15 formed in base portion 12 of back-flow prevention valve 10 and spring 13' is positioned in annular space 15 with one end attached to base portion 12 and one end attached to disc portion 7 to bias the back-flow prevention valve 10 against the disc portion 7 of intake valve 6 until the gas in the combustion chamber reached a predetermined pressure sufficient to overcome the spring 13' and force the extended portion 11 of back-flow prevention valve 10 away from the disc portion 7 to block intake port 5.

Figure 5A:
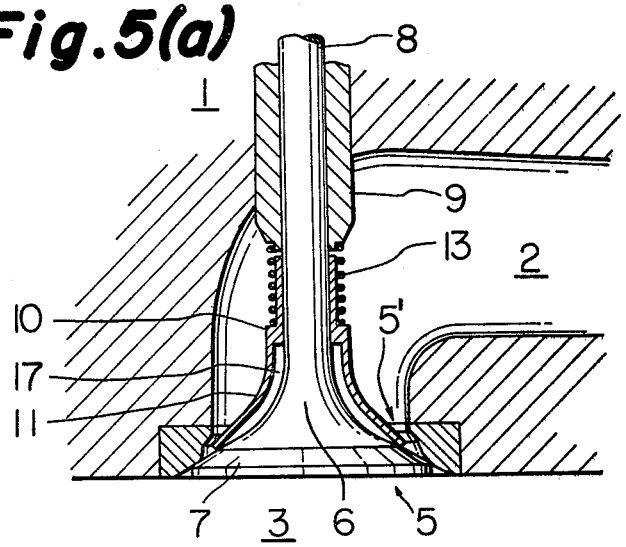
FIGS. 5, 5(*a*), (*b*) and (*c*) are cross-sectional views of yet another embodiment of this invention.
Figure 5B:
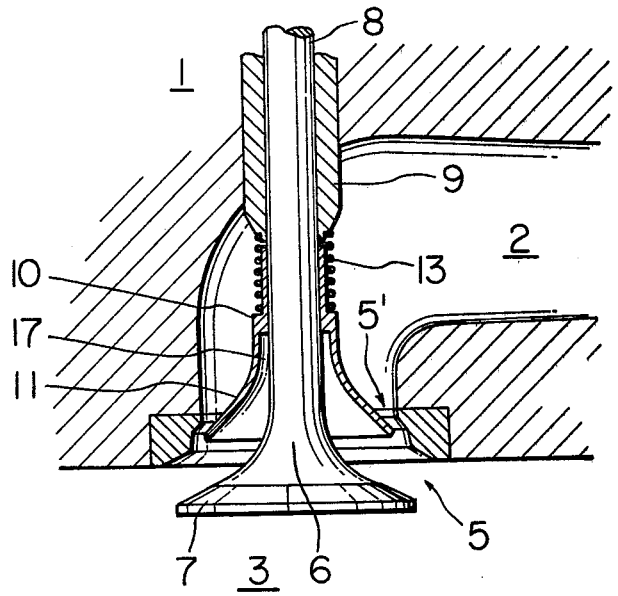
Figure 5C:
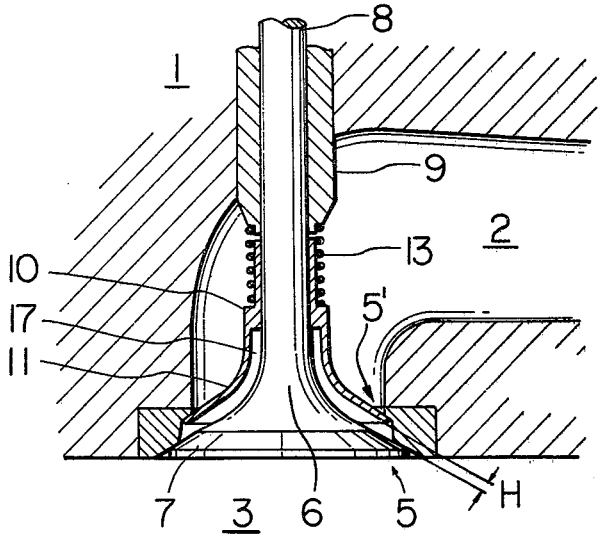

In accordance with the invention, the embodiment shown in FIG. 5(*a*) discloses an intake valve mechanism wherein the disc portion 7 of intake valve 6 extends beyond the expanded portion 11 of back-flow prevention valve 10. Spring 13 is proportioned to result in expanded portion 11 being held away from disc portion 7 of intake valve 6 when intake valve 6 is opened as shown in FIG. 5(*b*). The space between expanded portion 11 and disc portion 7 allows the pressure of the gases in combustion chamber 3 to act on expanded portion 11 and hold expanded portion 11 against recessed seat 5' of intake port 5 whenever the pressure in combustion chamber 3 exceeds the sum of the pressure of spring 13 and the pressure of the air-fuel mixture in intake passage 2. When intake valve 6 closes as shown in FIG. 5(*c*), a gap 17 of width H is momentarily created between expanded portion 11 and disc portion 7. However, as the pressure in gap 17 leaks off, expanded portion 11 is quickly forced against disc portion 7 by spring 13 to resume the position shown in FIG. 5(*a*).

Accordingly, this embodiment dispenses with extended edges 14 that are provided in the embodiments of FIGS. 1 and 3 to receive the pressure of gases in chamber 3 because this embodiment is designed to receive such gas pressure directly on expanded portion 11.

Figure 6:
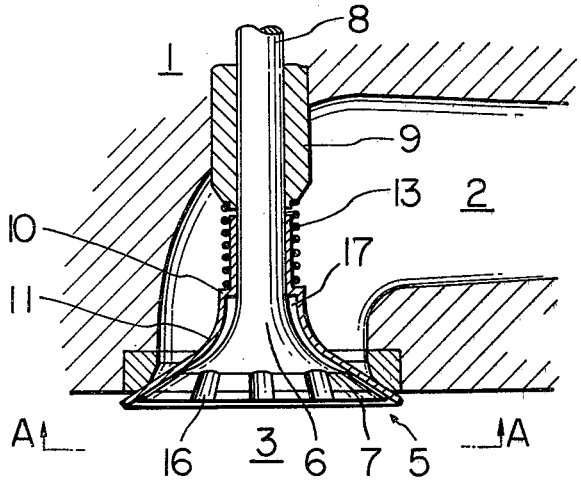
FIG. 6 is a cross-sectional view of a further embodiment of this invention.
Figure 7:
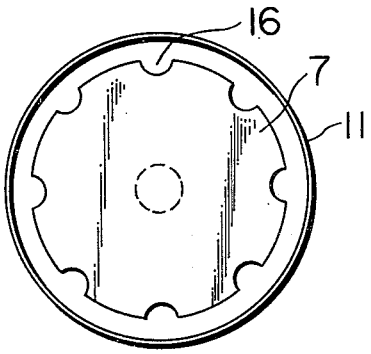
FIG. 7 is a plane sectional view as seen from plane A—A of FIG. 6.

In accordance with the invention, an embodiment is shown in FIGS. 6 and 7 wherein the disc portion 7 of the intake valve 6 includes notches 16 along the periphery of the disc portion 7 for allowing gases in the combustion chamber 3 to continuously exert pressure on the expanded portion 11 of back-flow prevention valve 10. Accordingly, the pressure of the gases in combustion chamber 3 is introduced through notches 16 to gap 17 between the expanded portion 11 and the intake valve 6. This embodiment also makes it unnecessary to provide an edge 14 to receive the pressure of the gas back-flow as is done in the embodiments of FIGS. 1 and 3.

Figure 9:
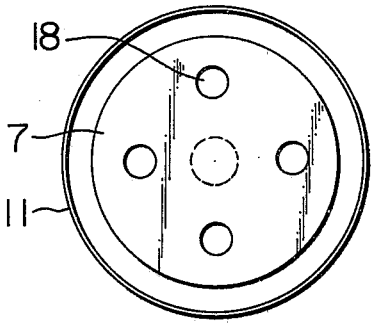
FIG. 9 is a planar sectional view as seen from plane B—B in FIG. 8.
Figure 8:
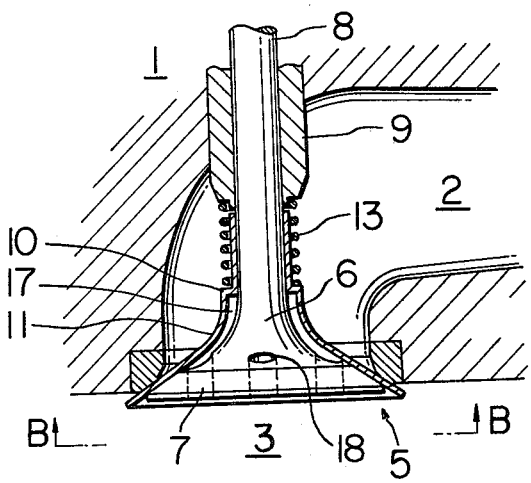
FIG. 8 is a cross-sectional view of a still further embodiment of this invention.

In accordance with the invention, an additional embodiment is shown in FIGS. 8 and 9 wherein the disc portion 7 of said intake valve 6 includes openings 18 penetrating through disc portion 7 to allow gases in the combustion chamber 3 to continuously exert pressure on expanded portion 11. This design permits the gas in combustion chamber 3 to pass through openings 18 into gap 17 between the extended portion 11 and intake valve 6 accordingly making it unnecessary to provide the edges 14 to receive the pressure of the gas back flow as was done in the embodiments in FIGS. 1 and 3.

As was explained above with respect to FIGS. 1 and 2, the embodiments in FIGS. 3 through 9 also reliably prevent gases in the combustion chamber 3 from being blown back into intake passage 2, thereby eliminating lowering of operational performance due to the poor ignition and irregular rotation of gases inherent in the medium to low speed ranges of the conventional internal combustion engine. In addition, the increased efficiency results in higher engine output and fuel economy. Finally, by utilizing a means for continuously biasing the back-flow prevention valve to track the movement of the intake valve, the resistance that the mass of back flow prevention valve 10 creates against the intake flow of the air-fuel mixture is eliminated and accordingly the intake efficiency of the engine is maximized.

It will be apparent to those skilled in the art that various modifications and variations could be made in the intake valve mechanism of the invention without departing from the scope or spirit of the invention.

What is claimed is:

1. An intake valve mechanism for preventing the back-flow of gases from a combustion chamber of an internal combustion engine out of an intake port of the chamber, said intake valve mechanism comprising:

(a) poppet valve means for alternately opening and blocking the intake port, said poppet valve means including an intake valve having a stem and further having a disc portion mounted on one end of said stem, said poppet valve means further including a valve guide for supporting said stem to allow said disc portion to selectively open and block said intake port of the engine;

(b) back-flow valve means positioned between said poppet valve means and said intake port for blocking said intake port in response to pressure in the combustion chamber, said back-flow valve means including a back-flow prevention valve having a hollow base and further having an expanded portion mounted on one end of said base, said hollow base being mounted concentric to said stem to allow said expanded portion to slide back and forth between said intake port and said disc portion, said disc portion of said intake valve extending parallel said expanded portion of said back-flow prevention valve, said intake port including a recessed seat to receive said expanded portion; and (c) means for continuously biasing said back-flow valve means toward said disc portion of said poppet valve means, said biasing means having sufficient strength to prevent said back-flow valve means from blocking said intake port when said poppet valve means is open until the pressure in the combustion chamber reaches a predetermined value, said biasing means including a spring positioned concentric to said hollow base of said back-flow prevention valve, said spring being proportioned for biasing said expanded portion substantially against said disc portion when said poppet valve means is closed, and for leaving a gap between said expanded portion and said disc portion under conditions of back-flow pressure when said poppet valve means is open.

2. An intake valve mechanism as claimed in claim 1 wherein said expanded portion of the back-flow prevention valve extends beyond said disc portion of said intake valve.

3. An intake valve mechanism as claimed in claim 1 wherein an annular space is formed in said base portion of said back-flow prevention valve and said spring is positioned in said annular space with one end attached to said base portion and one end attached to said disc portion to bias said back-flow prevention valve against said disc portion of said intake valve until the exhaust gases in the combustion chamber reach said predetermined pressure sufficient to overcome said spring and force said expanded portion away from said disc portion to block said intake port.

4. An intake valve mechanism as claimed in claim 1 wherein said disc portion of said intake valve includes notches along the periphery of said disc portion for allowing said gases in the combustion chamber to continuously exert pressure on said expanded portion.

5. An intake valve mechanism as claimed in claim 1 wherein said disc portion of said intake valve includes openings penetrating through said disc portion to allow said gases in the combustion chamber to continuously exert pressure on said expanded portion.

6. An intake valve mechanism as claimed in claim 1 wherein said disc portion of said intake valve extends beyond said expanded portion of said back-flow prevention valve.

* * * * *

UNITED STATES PATENT AND TRADEMARK OFFICE

CERTIFICATE OF CORRECTION

PATENT NO. : 4,094,277

DATED : June 13, 1978

INVENTOR(S) : Kenji Goto et al

It is certified that error appears in the above-identified patent and that said Letters Patent are hereby corrected as shown below:

On the first page of the patent, please correct the name of the assignee to read --Toyota Jidosha Kogyo Kabushiki Kaisha--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*